US007210562B2

(12) United States Patent
Morii et al.

(10) Patent No.: US 7,210,562 B2
(45) Date of Patent: May 1, 2007

(54) OIL PAN STRUCTURE FOR FOUR-CYCLE ENGINE

(75) Inventors: Hideshi Morii, Shizuoka (JP); Osamu Sekimoto, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 453 days.

(21) Appl. No.: 10/618,422

(22) Filed: Jul. 11, 2003

(65) Prior Publication Data

US 2004/0084250 A1 May 6, 2004

(30) Foreign Application Priority Data

Nov. 5, 2002 (JP) ..... 2002-321450

(51) Int. Cl.
*F16N 31/00* (2006.01)

(52) U.S. Cl. ..... 184/106; 123/196 A

(58) Field of Classification Search ..... 184/106, 184/6.24; 123/195 C, 196 A
See application file for complete search history.

(56) References Cited

U.S. PATENT DOCUMENTS 5,199,395 A * 4/1993 Mizumura et al. .... 123/196 AB
5,544,632 A * 8/1996 Choate ..... 123/195 C
6,058,898 A * 5/2000 Freese, V ..... 123/195 C
6,237,720 B1 * 5/2001 Sutton ..... 184/106
2001/0037788 A1 * 11/2001 Okuda et al. ..... 123/195 C
2004/0084250 A1 * 5/2004 Morii et al. ..... 184/106

FOREIGN PATENT DOCUMENTS

JP 2001-193559 A1 7/2001

* cited by examiner

*Primary Examiner*—David M. Fenstermacher
(74) *Attorney, Agent, or Firm*—Darby & Darby

(57) ABSTRACT

An oil pan structure for a four-cycle engine, in which oil stored in an oil pan is sucked up by an oil pump through an oil strainer and in which oil lubrication is performed by supplying the sucked oil again to each of parts of the engine to be lubricated. In this oil pan structure, a bottom portion of the oil pan is formed nearly like a bowl by being swelled to a side, which is opposite to a crankcase, from an attaching peripheral portion, to which a crankcase lower-part is attached, toward a central portion thereof. An oil pan cover covering a part of the bottom portion is separately provided thereon. Oil passages and are formed from the oil pan cover and the bottom portion. An oil introduction opening portion and an oil suction opening portion 82 are formed in the bottom portion.

5 Claims, 8 Drawing Sheets

OIL PAN STRUCTURE FOR FOUR-CYCLE ENGINE

BACKGROUND OF THE INVENTION

The present invention generally relates to a four-cycle engine and, more particularly, to an oil pan structure effective in a four-cycle engine, in which oil lubrication is performed by a forced oil feed method.

In recent years, demands for exhaust emission control and improvement of fuel economy against environment problems have promoted the employment of four-cycle engines to be mounted on vehicles.

However, the four-cycle engine requires an oil pan to be provided in a lower part thereof so as to perform oil lubrication of each part of the engine. Thus, the four-cycle engine has a problem in that the outside dimension thereof is large, as compared with that of a two-cycle engine.

Therefore, it is desired that a four-cycle engine to be mounted on a vehicle, such as a small snowmobile, which has limited storage space, is small and saves space as much as possible.

Hereinafter, oil lubrication to be performed in a conventional four-cycle engine is described.

The oil lubrication to be performed in the conventional four-cycle engine has the following steps. That is, oil fed by, for example, an oil pump to each of parts to be lubricated runs down after the lubrication. Then, the oil is stored in an oil pan provided in a lower part of the engine. Subsequently, the stored oil is sucked by the oil pump, and fed to each of the parts to be lubricated.

Dry sump method and a wet sump method are known as the oil lubrication methods for a four-cycle engine.

The wet sump method is adapted so that all oil is stored in an oil pan provided in a lower part of a crankcase, that the oil is fed from the oil pan by the oil pump to each of the parts to be lubricated in the engine, and that return oil completed the lubrication is stored again in this oil pan.

On the other hand, the dry sump method is adapted so that the oil tank separated from an engine body is provided, that return oil stored in the oil pan upon completion of the lubrication is sucked by an oil pump, and then fed to the oil tank, and that the oil is fed by another oil pump from the oil tank to each of parts to be lubricated.

That is, according to the dry sump method, there is no need for storing all oil in the lower part of the engine. Thus, as compared with the wet sump method, the capacity of the oil pan can be reduced. Consequently, the dry sump method has merit in that the height of the engine can be reduced.

Hitherto, there has been proposed an apparatus configured by modifying an oil pan in such a way as to prevent the oil pan from interfering with other constituent parts arranged in the lower part of a four-cycle engine, so as to save space accommodating the engine in the case of mounting the engine employing the wet sump method on, for instance, a vehicle, such as a small snowmobile, which has limited space for accommodating the engine (see the patent document: Japanese Application Publication Number: 2001-193559 (KOKAI 2001-193559) pages 3 to 4, and FIG. 1).

However, according to the aforementioned conventional art apparatus, the engine can be mounted by modifying the oil pan in such a way as to have a small height, while the capacity of the oil pan itself is unchanged, so that the size of an engine body is substantially unchanged.

Then, the capacity of the oil pan can be reduced by employing the dry sump method as a method for performing oil lubrication in the engine. However, the conventional art apparatus has problems in that when the capacity of the oil pan is reduced, the routing of an oil strainer to be installed in an intake pump (that is, as cavenging pump) becomes complicated, so that the oil strainer is subjected to shape constraints.

Further, because the intake pump feeds oil to the separated oil tank, it is necessary that the capacity of the intake pump is more than that of a supply pump (that is, a feed pump) for supplying oil to each of parts of the engine, which are to be lubricated, and that the oil strainer ensures a section area sufficient to the extent that the oil strainer can be prevented from causing intake resistance.

For example, when the oil strainer is formed from a pipe member, the oil strainer is subjected to pipe-diameter and routing constraints because it is impossible to form the oil strainer into a steeply curved shape. Further, when the oil strainer is formed by resin molding or casting, the apparatus has a problem in that the structure of a stationary part of the oil strainer becomes complicated so as to be prevented from being damaged owing to vibrations thereof.

Moreover, in the case of an engine to be mounted on a snowmobile, an oil filter is disposed in front of the engine owing to maintainability. Therefore, it is difficult to dispose the oil pump at the engine's rear portion in which the placement of an oil gallery is difficult. With such configuration, when the engine is mounted thereon during a state in which the engine is backwardly tilted, it is difficult to ensure the oil passage led to the scavenging pump.

SUMMARY OF THE INVENTION

The invention is accomplished in view of the problems of the convention alart. Accordingly, an object of the invention is to provide an oil pan structure for a four-cycle engine enabled to reduce the height of the engine by constructing a space-saving oil passage with a simple configuration, and as to have good workability.

The invention relates to an oil pan structure for a four-cycle engine to be mounted on a compact vehicle, such as a motor cycle or a snowmobile. According to the invention, there is provided an oil pan structure for a four-cycle engine configured so that an oil pan is provided in a lower part of a crankcase, that the oil stored in the oil pan is sucked by an oil pump through an oil strainer, and that oil lubrication is performed by supplying the oil again to each of parts to be lubricated. In this structure, a bottom portion of the oil pan is formed by being swelled nearly like a bowl to a side opposite to the crankcase from an attaching peripheral portion toward a central portion. A cover member covering a part of the bottom portion is separately provided on a swelled portion of the bottom portion. An oil passage is formed from the cover member and the bottom portion. An oil introduction opening portion, which communicates the oil passage to inside of a crankcase, and an oil suction opening portion, in which a communication member communicating the oil passage to the oil pump is provided, are formed in the bottom portion.

Further, preferably, in the oil pan structure according to the invention, the oil strainer is provided on the oil passage. Especially, when the oil strainer is provided in the vicinity of the oil introduction opening portion, favorable workability is obtained.

Moreover, it is preferable that in the oil pan structure according to the invention, the communication member has a pipe member communicating the oil pump to the oil passage, that an end of the pipe member is integrally attached to the oil pump, and that the other end of the pipe member is detachably attached to the oil suction opening portion through a seal member.

Furthermore, preferably, in the oil pan structure according to the invention, a coolant water passage is formed in an outer circumferential portion of the oil passage.

DESCRIPTION OF THE PREFFERRED EMBODIMENT

Figure 1:
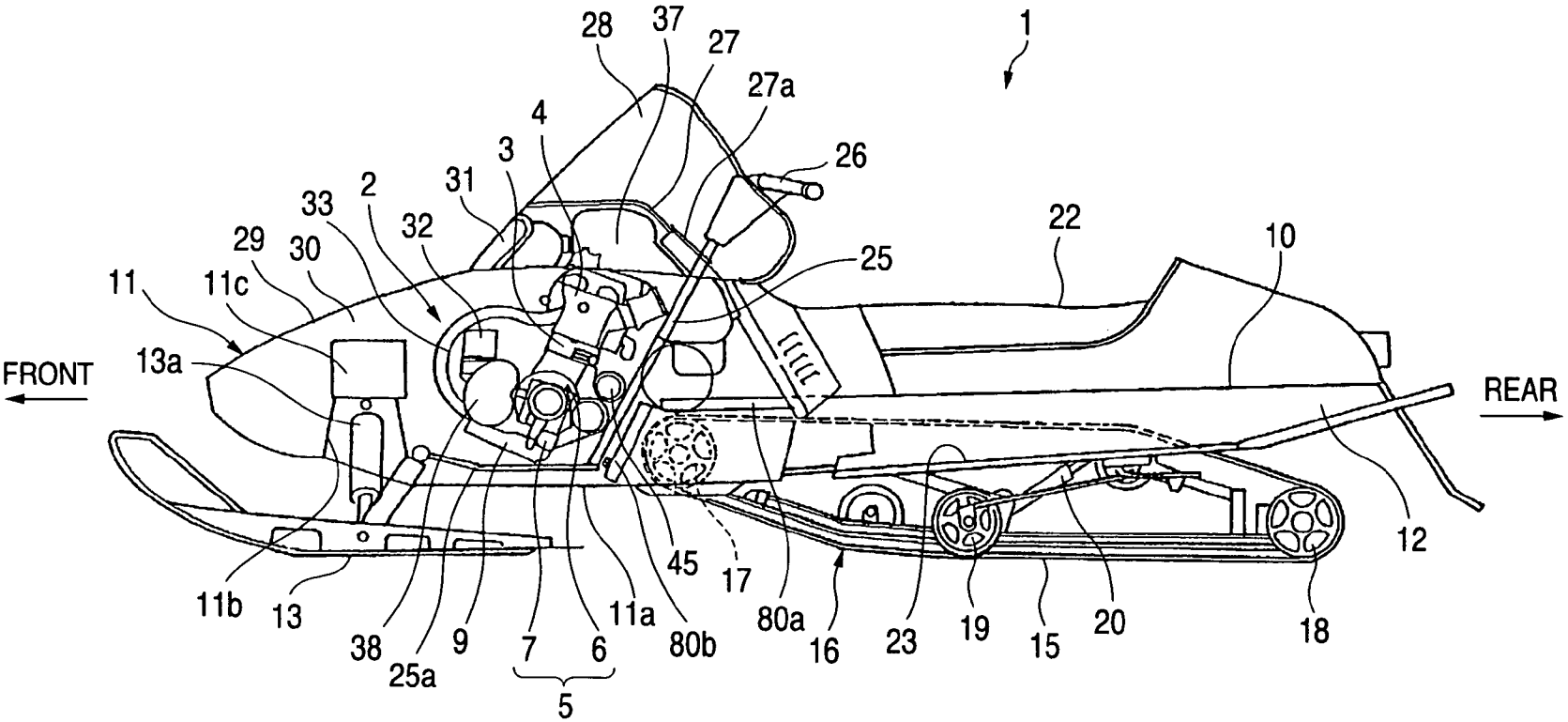
FIG. 1 is a side view illustrating the entire configuration of a snowmobile employing an oil pan structure for a four-cycle engine according to a first embodiment of the invention.

Hereinafter, a first embodiment of the invention is described in detail by referring to the drawings.

Figure 2:
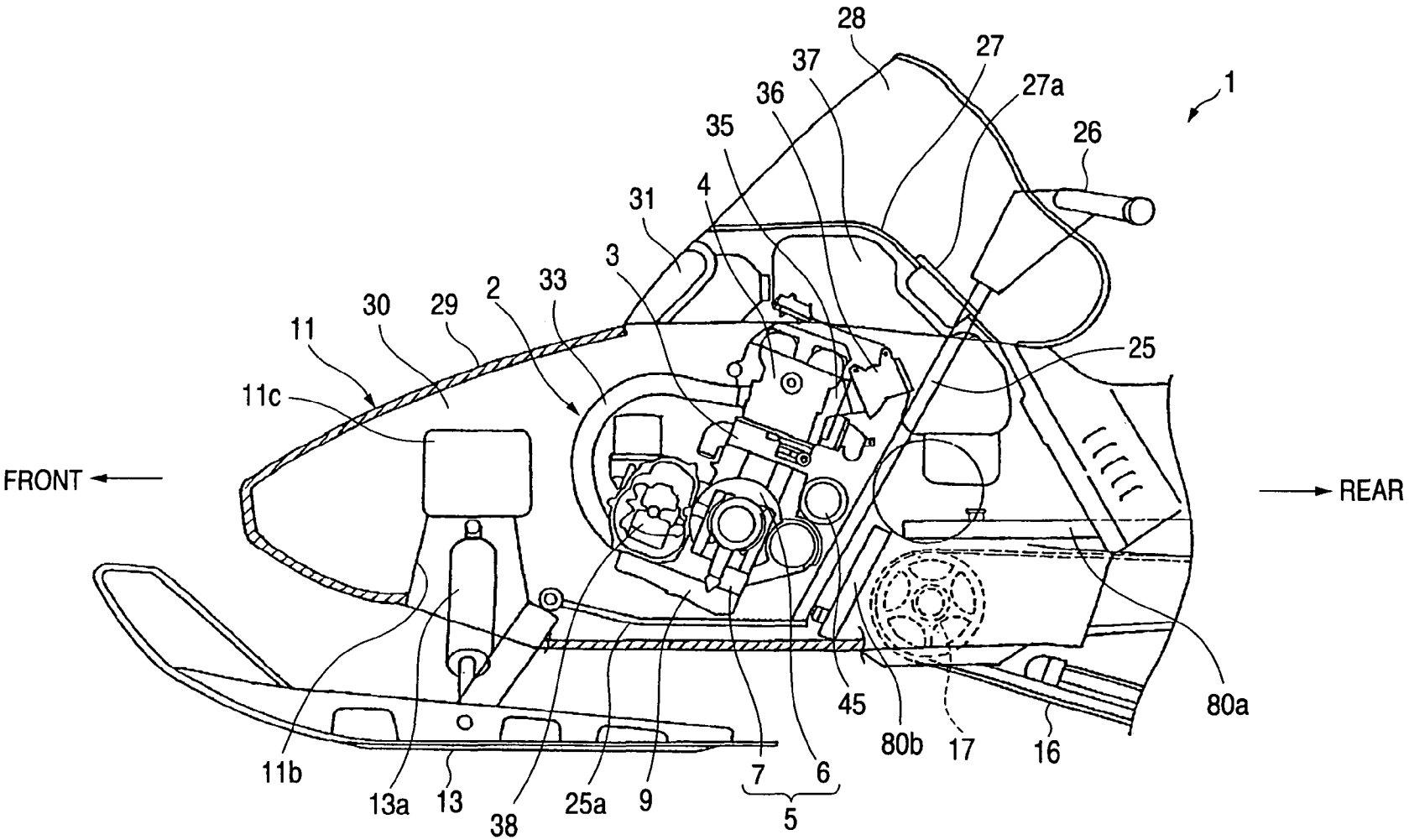
FIG. 2 is a side sectional view illustrating the configuration of a front portion of the vehicle body of the snowmobile.
Figure 3:
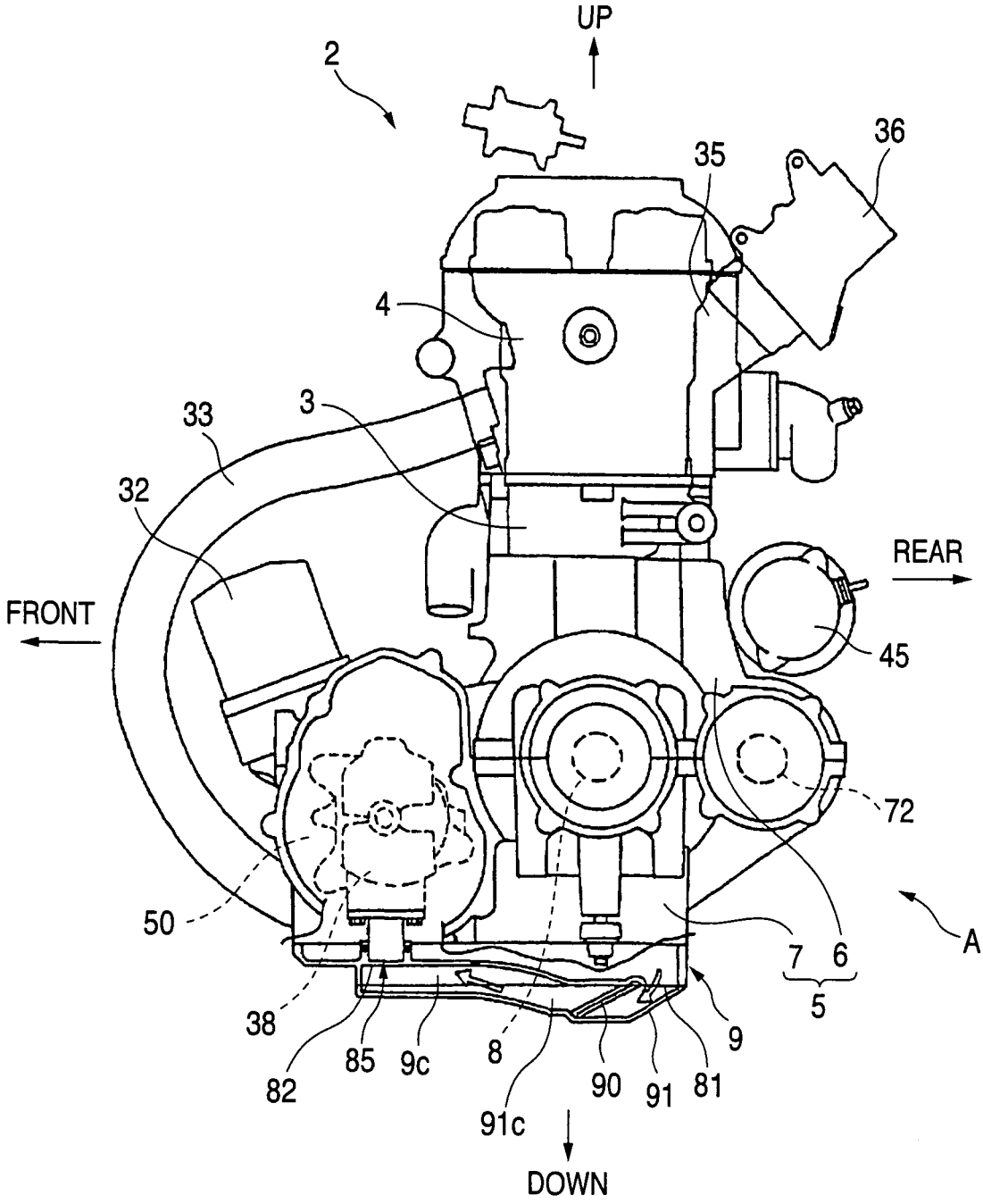
FIG. 3 is a side view illustrating the configuration of an engine according to this embodiment, taken from the left side thereof.
Figure 4:
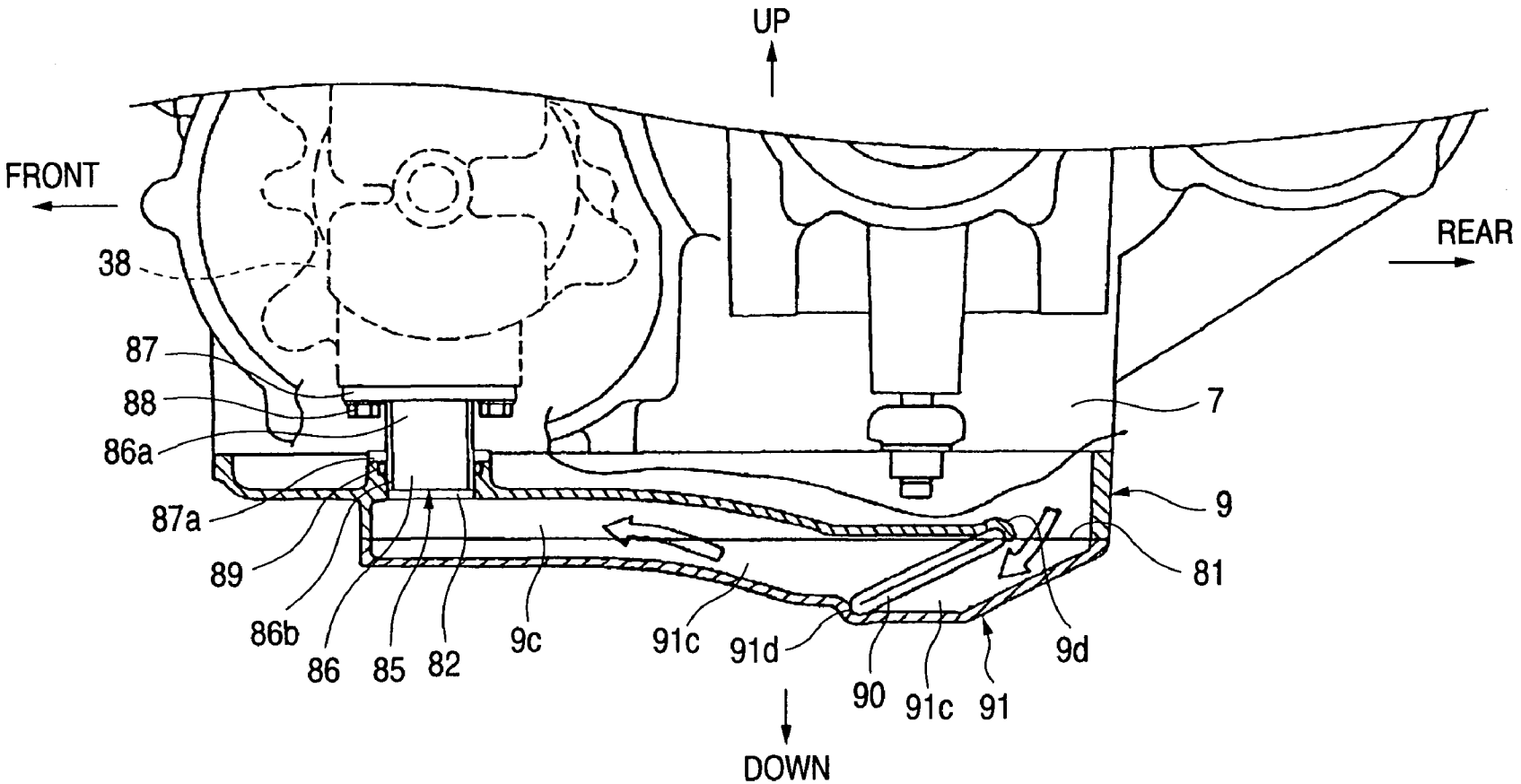
FIG. 4 is a partially sectional view illustrating the configuration of an oil pan of the engine.
Figure 5:
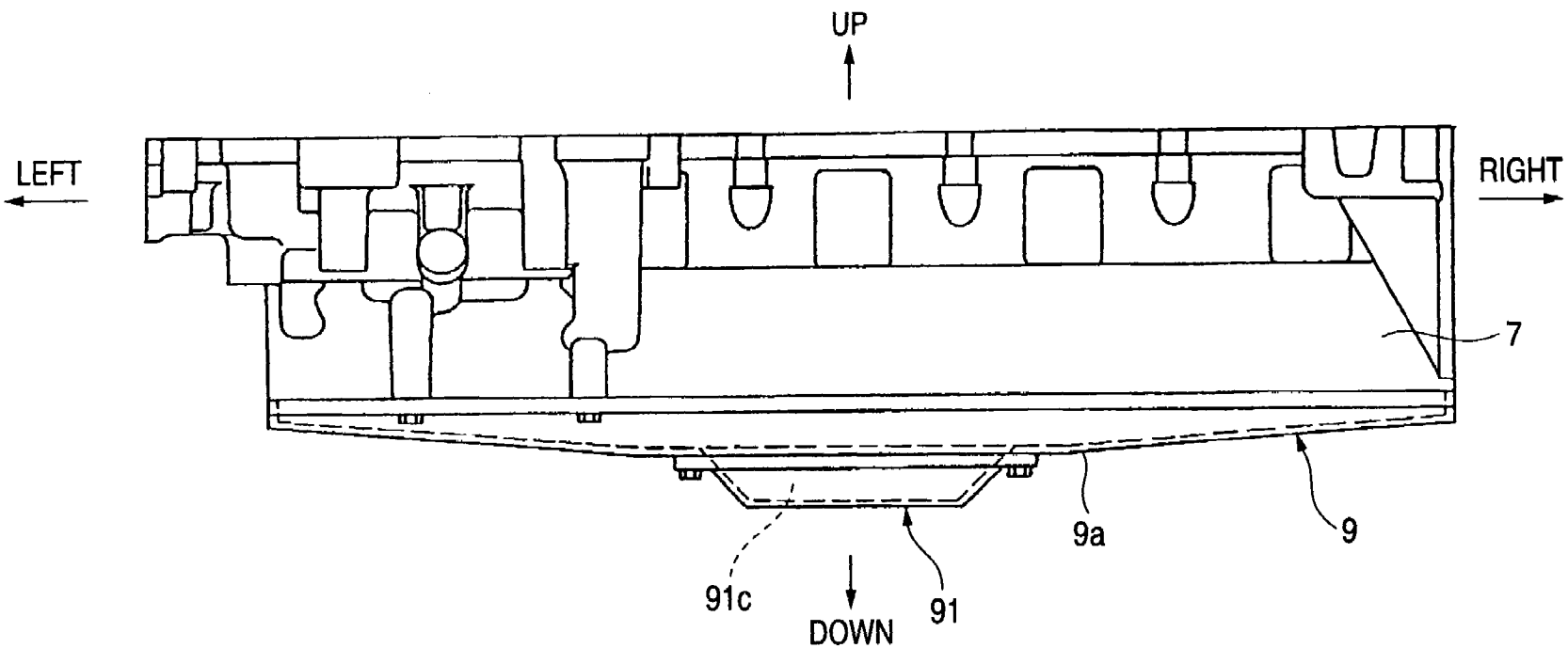
FIG. 5 is a view taken along an arrow A in FIG. 3.
Figure 6:
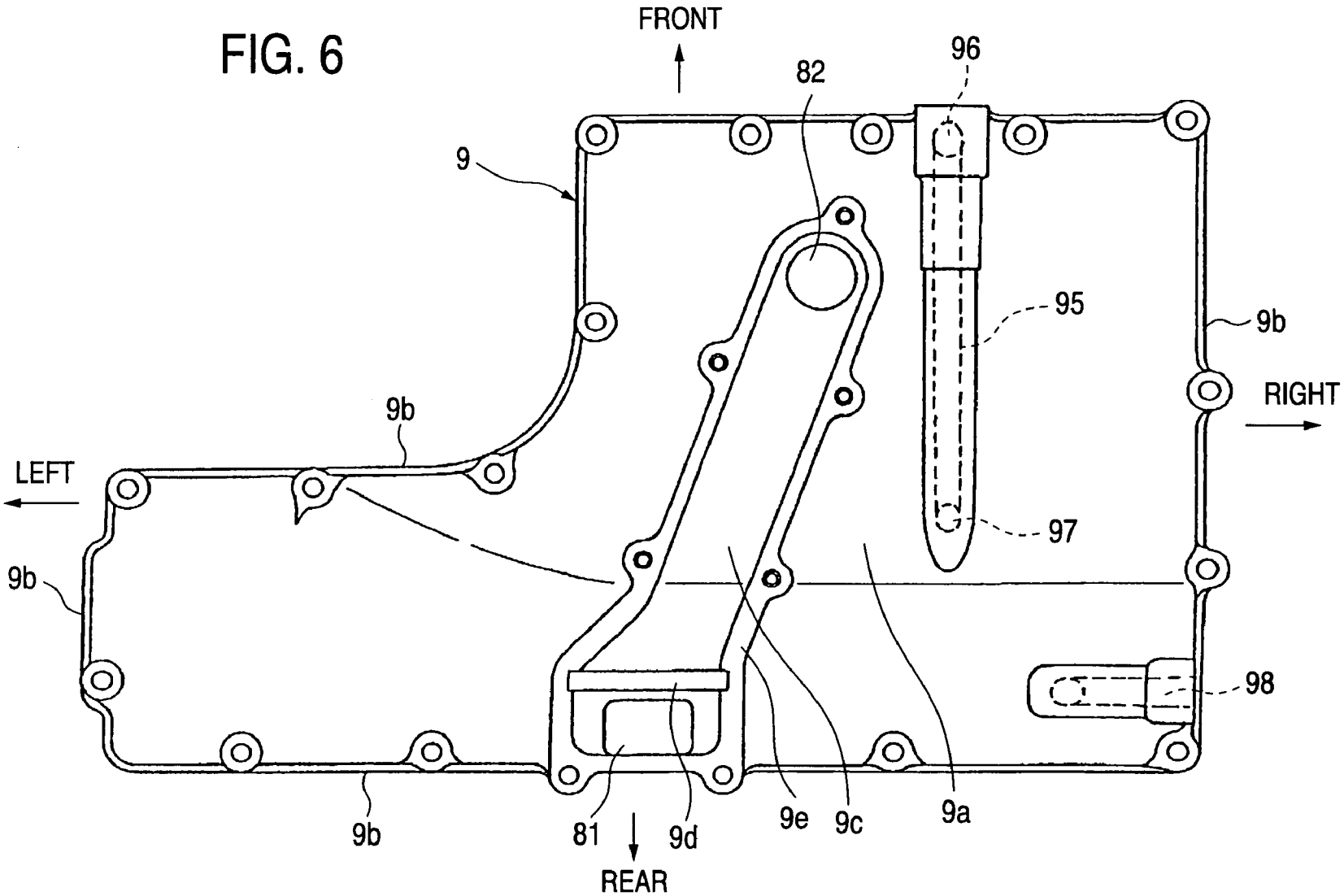
FIG. 6 is a plan view illustrating the oil pan taken from below.

FIGS. 1 to 5 illustrate the first embodiment of an oil pan structure for a four-cycle engine according to the invention. FIG. 1 is a side view illustrating the entire configuration of a snowmobile employing an oil pan structure for a four-cycle engine according to the embodiment of the invention. FIG. 2 is a side sectional view illustrating the configuration of a front portion of the vehicle body of the snowmobile. FIG. 3 is a side view illustrating the configuration of an engine according to this embodiment, taken from the left side thereof. FIG. 4 is a partially sectional view illustrating the configuration of an oil pan of the engine. FIG. 5 is a view taken along an arrow A in FIG. 3. FIG. 6 is a plan view illustrating the oil pan taken from below.

In the figures, the same reference character designates the same constituent element.

This embodiment is obtained by constructing an oil pan structure for a four-cycle engine according to the invention in an engine 2 to be mounted on what is called a snowmobile 1 serving as a small snow vehicle.

First, the configuration of the snowmobile 1 according to this embodiment is described herein below.

As shown in FIG. 1, in the snowmobile 1, paired left and right skis 13 are turnably installed in a frame front part (that is, an engine mount frame) 11 of a front portion of a vehicle body of a vehicle body frame 10 extending in a frontward-rearward direction. Drive crawler for circulating a track belt 15 is placed at a lower portion of a frame rear part 12 of a rear portion of the vehicle body. The crawler 16 has a drive wheel 17 placed at the front end of a frame rear portion 12, a driven wheel 18 placed at the rear end thereof, a plurality of middle wheels 19, a suspension mechanism 20, and the track belt 15, which circulates by being wound around each wheel.

The vehicle body frame 10 is formed in such a way to have a monocoque frame structure. In the frame front part 11, on which the engine 2 is mounted, a part provided frontwardly of a main part 11*a* is formed in such a manner as to upwardly project. Moreover, a front suspension housing 11*b* for accommodating an upper part of a front suspension 13*a* supporting the steering skis 13 is formed therein.

The frame rear portion 12 is provided in such a way as to extend in the frontward-rearward direction of the vehicle body to the rear end portion, and serves a cover accommodating the entire crawler 16 thereunder. A saddle-like sheet 22 is placed above the frame rear portion 12. Steps 23 are provided on both sides in the direction of vehicle-body-width of the sheet 22 in such a way as to be lower by one level.

A steering post 25 is erected nearly at a central portion of the vehicle body, which is located between the sheet 22 and the frame front part 11. A steering 26 is provided at the top portion of the steering post 25 in such a way as to be slightly and backwardly tilted and as to extend horizontally in a lateral direction. A steering tie-rod 25*a* for connecting the steering post 25 to the steering skis 13 is attached to the bottom portion of the steering post 25. The steering skis 13 are operated by the steering 26 through the steering post 25.

In the frame front part 11, an instrument panel 27 is provided in the vicinity of and frontwardly of the steering 26 in such a way as to cover an upper portion of the frame front part 11. Measuring meters, such as a speed-meter/tachometer 27*a*, are attached to the instrument panel 27.

A windshield 28 is erected in such a manner as to surround the frontward and outer circumferential portion of the instrument panel 27 and as to extend from the front to both sides so that the top edge thereof is backwardly tilted. Further, an engine hood 29 is formed at the front side of the instrument panel 27 in such a manner as to be nearly streamlined in a gradual decline from the base of the windshield 28 to the front thereof and as to be shaped nearly like a reversed ship bottom.

The engine hood 29 is provided in front of the instrument panel 27, and formed in such a manner as to extend from a position, which is lower than the front end portion of the instrument panel 27 by one step, to the tip end portion thereof. A headlight 31 for forward illumination is provided at a step-like portion between the engine hood 29 and the instrument panel 27. An engine room 30 is formed under the instrument panel 27 and the engine hood 29, which are provided in this manner.

A heat exchanger 80*a* is provided in the engine room 30 in such a way as to face and extend nearly in parallel to the track belt 15 frontwardly and downwardly of the frame rear part 12 and upwardly in the vehicle traveling direction of the crawler 16. A front-side heat exchanger 80*b* is provided in such a way as to face the track belt 15 in front of the front side in the vehicle traveling direction of the crawler 16 in a state in which the top portion of this exchanger is slightly and backwardly tilted. Each of the heat exchangers 80*a* and 80*b* is almost rectangular when seen in a plan view.

Next, the configuration of the engine according to this embodiment is described in detail hereinbelow.

As shown in FIGS. 1 and 2, the engine 2 is placed nearly at a central portion in the engine room 30 formed in the frame front part 11 constructed at the front portion of the vehicle body of the snowmobile 1 and in the proximity of a portion located under the steering post 25 so that a cylinder 3 is tilted backwardly in the traveling direction of the snowmobile (that is, so that the center of a cylinder head 4 located behind a crankshaft 8).

As shown in FIGS. 2 and 3, the engine 2 is a water-cooled four-cycle engine in which four cylinders are placed in parallel in the direction of width of the vehicle body (that is, the crankshaft 8 is placed by being directed in the direction of width of the vehicle body). The engine 2 is placed nearly at the central portion of the vehicle body front part of the snowmobile 1 in a condition in which a part thereof at the side of the cylinder 3 is tilted in the backward direction of the vehicle body.

A cylinder head 4 is provided above the cylinder 3. Exhaust tube (that is, an exhaust pipe) 33 extending to the front of an exhaust port and then turning downwardly to the bottom portion of the engine 2 is provided at a front portion of the cylinder head 4. An oil tank 11*c* is placed frontwardly of the exhaust pipe 33 above the front suspension housing 11*b* formed at the bottom part of the main portion of the frame front part 11.

Intake path including an intake passage 35, a throttle body 36, and an air cleaner box 37is provided behind the cylinder head 4 frontwardly of the steering post 25, that is, between the body of the engine 2 and the steering post 25.

The intake passage 35 is placed at a position higher than the cylinder head 4, and constituted by a "downdraft system" according to which air supplied to an intake port (not shown) is blown down from above, and juxtaposed with the steering post 25.

A part of the intake path including the throttle body 36 is placed a position higher than the cylinder head 4, and placed in a space within the engine room 30 formed behind the headlight 31 under the instrument panel 27 above the engine 2.

As illustrated in FIG. 3, a crankcase 5 is provided under the cylinder 3. The crankcase 5 is constituted by employing a split construction that has a crankcase upper-part 6 and a crankcase lower-part 7, which integrally constitute the cylinder 3. In the crankcase 5, the crankshaft 8 is placed almost in parallel with the direction of width of the vehicle body. An oil pan 9 is provided under the crankcase lower-part 7 in a state in which the oil pan 9 is placed in the vicinity of the bottom portion (or bottom surface) of the engine room 30.

A starter motor 45 is placed behind the cylinder 3 and under the intake passage 35 on the right side in the direction of vehicle body width rearwardly of the crankcase 5. That is, the starter motor 45 is placed rearwardly of the crankshaft 8. Further, a flywheel magneto (not shown) is provided on the right-side wall of the crankcase 5 in such a way as to be concentrically with the crank shaft 8.

A water pump 50 is disposed at a place nearly opposed to the starter motor 45 across the cylinder 3 under the exhaust pipe 33. That is, the water pump 50 is disposed frontwardly of the crank shaft 8.

Oil pump 38 is provided on the left side in the direction of vehicle body width frontwardly of the crankcase 5 concentrically with the water pump 50 nearly in parallel with the crankshaft 8. Oil filter 32 having an interpolation oil filter member for cleaning oil, which is fed from a feed pump (not shown), before being sent to each of parts of the engine is provided above the oil pump 38 in such a manner as to upwardly project.

As shown in FIGS. 4 and 5, the oil pan 9 is attached to the bottom surface portion of the crankcase lower part 7. The bottom portion 9*a* of the oil pan 9 is formed in such a way as to be swelled to a side opposite to the crankcase (that is, in the downward direction, as viewed in these figures) from an attaching peripheral portion 9*b*, to which the crankcase lower-part 7 is attached, toward a central portion.

The bottom portion 9*a* is formed in such a manner as to be most swelled in a direction from the rear side of the almost central portion extending in the direction of vehicle body width to the front side. In this portion extending in such a direction, a concave oil passage 9*c* shaped like a cylindrical face protruded to a crankcase (that is, is concave to the crankcase side, as viewed in an external view).

The oil passage 9*c* has a rear end portion, in which an oil introduction opening portion 81 communicating the oil passage 9*c* with the inside of the crankcase is formed as an opening, and also has a front end portion in which an oil suction opening portion 82 is formed at a place opposed to the oil pump 38.

A joint 85 serving as a communication member, which communicates the oil passage 9*c* with the oil pump 38, is provided in the oil suction opening portion 82.

The joint 85 comprises a pipe portion 86, which communicates the oil passage 9*c* with the oil pump 38, and a flange portion 87 integrally provided at an end 86*a* of the pipe portion 86.

Further, in the joint 85, the flange portion 87 is integrally mounted to the oil pump 38 with mounting bolts 88. The other end 86*b* of the pipe portion 86 is detachably attached to the oil suction opening portion 82 through O-ring 89 serving as a seal member provided at the inner-diameter side of the oil suction opening portion 82. Moreover, the opening-side flange portion 87*a* is integrally provided in such a way as to abut against the end portion of the oil suction opening portion 82.

Oil strainer mounting groove 9*d* for placing the oil strainer 90 is formed in the vicinity of the oil introduction opening portion 81 of the oil passage 9*c* so that the inner circumferential surface of the oil passage 9*c* is depressed like a groove extending in the circumferential direction.

Incidentally, reference character 9*e* designates a mounting flange portion for mounting an oil pan cover 91 (to be described later).

The oil pan cover 91 for covering the oil passage 9*c* formed in the bottom portion 9*a* is provided in the swelled bottom portion 9*a*.

The oil pan cover 91 is formed separately from the oil pan 9. As shown in FIG. 4, a part opposite to the oil passage 9*c* is formed by being swelled to the direction of an inner side opposite to the crankcase (that is, downwardly as viewed in this figure). This part and the oil passage 9*c* constitute the oil passage 91*c* enabling the circulation of oil.

As shown in FIG. 4, an oil strainer mounting groove 91*d* is depressed along the inner circumference in the oil passage 91*c* of the oil pan cover 91. During a state in which the oil strainer is mounted in the oil pan 9, the oil strainer mounting groove 91*d* is nearly continued to the oil strainer mounting groove 9*d* formed in the oil passage 9*c* of the oil pan 9, so that the oil strainer 90 is frontwardly placed, as viewed in a side view.

The oil strainer 90 is placed by performing the following placement of end portions thereof in such a way as to realize a large sectional area of the oil passage. That is, the end portion at the side of the oil passage 9*c* of the oil pan 9 is placed upstream of oil flow from an end portion at the side of the oil passage 91*c* of the oil pan cover 91. Moreover, a downstream side part of the oil strainer 90 with respect to the direction of oil flow is obliquely and upwardly tilted.

In this figure, reference numeral 95 designates an oil passage for supplying oil, which is formed in the oil pan 9. Reference numeral 96 denotes an oil introduction hole. Reference numeral 97 is an oil supply hole. Oil supplied from a feed pump (not shown) is introduced from the oil introduction hole 96 is supplied from the oil supply hole 97 to a main oil gallery of a cylinder block (not shown) through the oil passage 95.

Incidentally, reference numeral 98 is a drain hole formed in the oil pan 9.

Next, an assembly work and a maintenance work of an oil pan structure utilizing the oil pan structure according to this embodiment are described hereinbelow.

First, in the case of assembling the oil pan 9 to the crankcase lower part 7, the pipe portion 86 of the joint 85 attached to the intake port of the oil pump 38 is fitted into the oil suction opening portion 82 formed in the oil pan 9. At that time, the O-ring 89 is incorporated into the inner circumferential side of the oil suction opening portion 82. Thus, the pipe portion 86 and the oil suction opening portion 82 are detachably attached thereto through the O-ring 89 in a state in which the inside of the oil passage 9*c* is hermetically sealed through the O-ring 89.

Thus, the joint 85 is not tightly fitted into the oil suction opening portion 82. Consequently, the assemble-workability is drastically enhanced.

Further, when the oil pan cover 91 is attached to the oil pan 9, the oil pan cover 91 is attached to the oil pan 9 during a state in which the oil strainer 91 intervenes in the oil passage 91*c* formed between the oil pan 9 and the oil pan cover 91.

When the replacement and maintenance of the oil strainer 90 are performed, the oil strainer 90 can easily be taken out only by removing the oil pan cover 91 from the oil pan 9. Consequently, the workability can significantly be enhanced.

Next, an operation due to the oil pan structure of this embodiment is described hereinbelow.

Oil to be supplied to each parts of the engine 2 to be lubricated is supplied from the oil tank 11*c* by a feed pump (not shown) to each of the parts of the engine through the oil filter 32. Then, the oil having finished to be used for the lubrication of each of the parts flows down in the crankcase and further flows down to the oil pan 9. Finally, the oil is stored in the bottom portion 9*a*.

The oil stored in the bottom portion 9*a* of the oil pan 9 flows into the oil passage 91*c* from the oil introduction opening portion 81. Then, the oil is sucked by the oil pump 38 through the joint 85 from the oil suction opening portion 82 through the oil strainer 90, the oil passages 91*c* and 9*c*.

At that time, the pipe portion 86 of the joint 85 is communicated therewith in a condition in which the inside of the oil passage 9*c* is hermetically sealed by the O-ring 89. Thus, only the oil passing through the oil strainer 90 can be sucked without mixing foreign object included in the oil pan 9 thereinto.

The oil sucked by the oil pump 38 is sent to the oil tank 11*c*.

Thus, the oil used for the oil lubrication is once returned to the oil tank 11*c*. Then, the oil is fed by the feed pump again to each of the parts of the engine, which are to be lubricated. Subsequently, the oil lubrication is repeatedly performed.

With the aforementioned configuration, in the oil pan structure for a four-cycle engine according to this invention, the oil passages 9*c* and 91*c* can be formed only by attaching the oil cover 91 to the bottom portion 9*a* of the oil pan 9. Thus, the height of the engine can be reduced. Moreover, the oil pan structure, which excels in assemblability and workability, can be realized.

Further, according to this embodiment, the connection between the joint 85 and the oil passage 9*c* is achieved by a fitting method employing the O-ring 89 and to be performed in a detachable manner. Thus, the flexibility in mounting the crankcase lower-part 7 to the oil pan 9 is increased. The assemblability can be significantly improved.

Furthermore, according to this embodiment, the opening-side flange portion 87*a* is provided in the joint 85 in such a way as to abut against an end portion of the oil suction opening portion 82. This enables the O-ring mounting portion to have a simple configuration. Moreover, the assembly of the O-ring is facilitated.

Further, this embodiment is configured so that the oil strainer 90 for preventing foreign objects from being sucked intervenes in the oil passages 9*c* and 91*c*, which are formed from the oil pan 9 and the oil pan cover 91. Consequently, the oil pan 9 can be configured by having a minimum necessary shape without considering the placement of the oil strainer.

Further, according to this embodiment, the oil strainer 90 is placed in the oil passages 9*c* and 91*c* in a state in which the strainer 90 is obliquely inclined to the direction of flow of oil. Therefore, the intake resistance can be reduced by setting the sectional area of each of the oil passages to be large, while the height of each of the oil passages is limited to a small value.

Next, a second embodiment of the invention is described with reference to the accompanying drawings.

Figure 7:
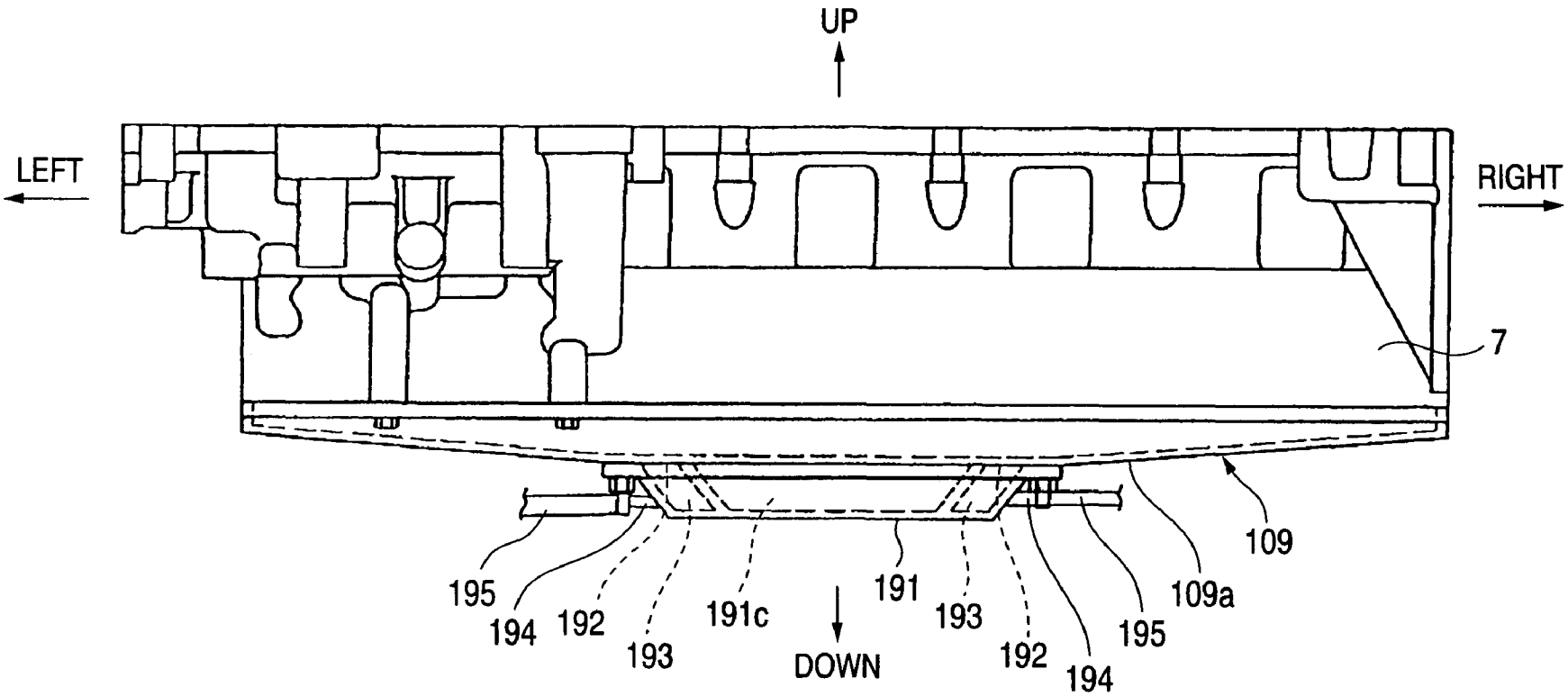
FIG. 7 is a side view illustrating the configuration of an oil pan structure for a four-cycle engine according to a second embodiment of the invention.
Figure 8:
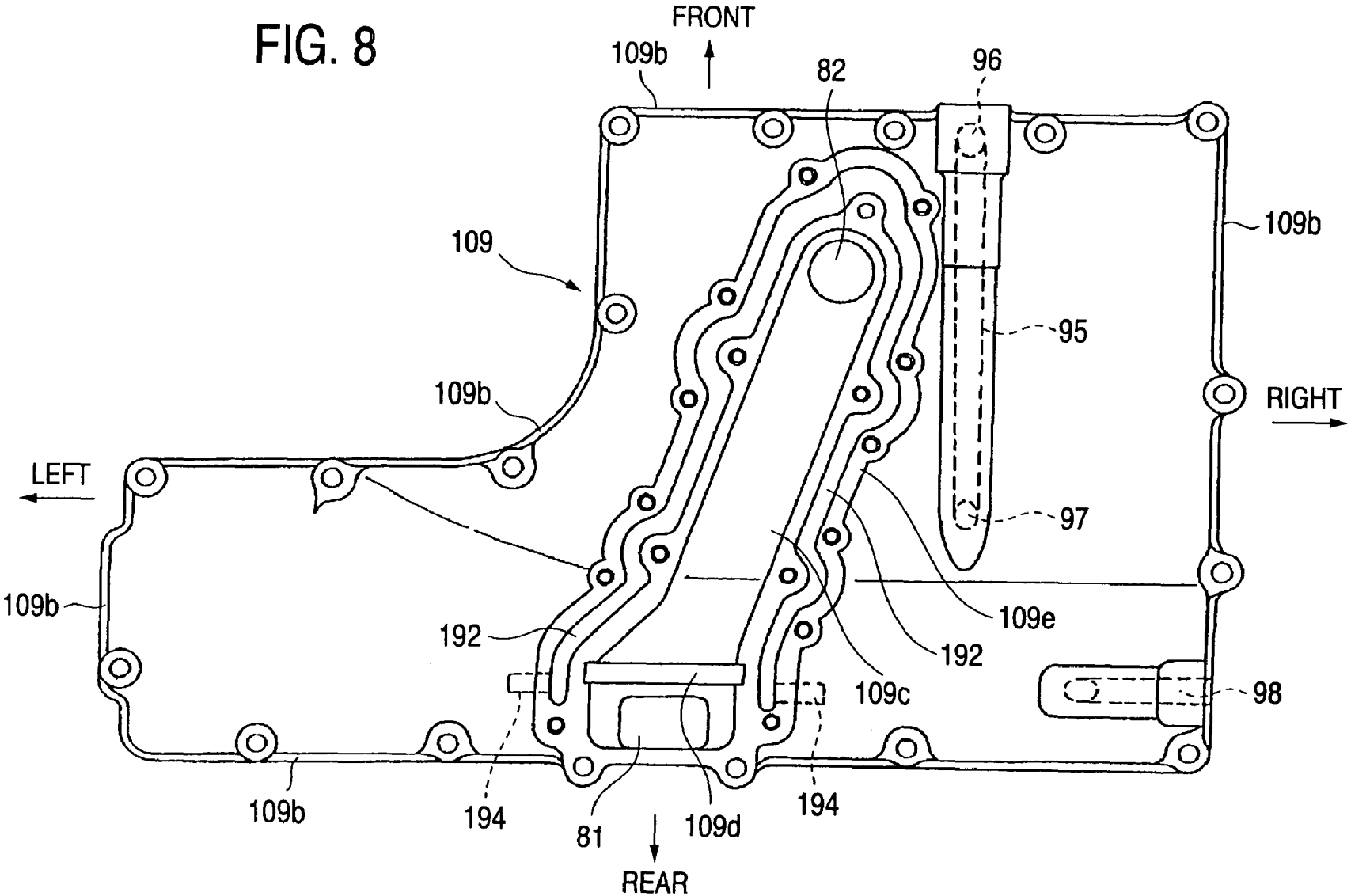
FIG. 8 is a plan view illustrating the configuration of the oil pan which is taken from below according to a second embodiment of the invention.

FIG. 7 is a side view illustrating the configuration of an oil pan structure for a four-cycle engine according to the second embodiment of the invention. FIG. 8 is a plan view illustrating the configuration of the oil pan, which is taken from below.

Incidentally, in these figures, an element designated by the same reference character, which denotes a constituent element of the first embodiment in the figures illustrating the first embodiment, designates the same constituent element. Thus, the description of such a constituent element is omitted.

As illustrated in FIGS. 7 and 8, the second embodiment is an oil pan structure for a four-cycle engine, which has a configuration that is nearly similar to the configuration of the oil pan structure according to the first embodiment. In the second embodiment, the bottom portion 109*a* of an oil pan 109 is formed by being swelled nearly like a part having inner side faces of a circular cylinder to a side opposite to a crankcase (that is, in a downward direction, as viewed in these figures) from the mounting peripheral portion 109*b*, to which a crankcase lower-part 7 is attached, toward a central portion.

The bottom portion 109*a* is formed by being most swelled in a direction from the rear side of nearly a central portion of a part extending in the direction of vehicle body width to the front side. In this bottom portion, a concave oil passage 109*c* shaped like a cylindrical face protruded to a crankcase (that is, is concave to the crankcase side, as viewed in an external view).

The oil passage 109*c* has a rear end portion, in which an oil introduction opening portion 81 communicating the oil passage 109*c* with the inside of the crankcase is formed as an opening, and also has a front end portion in which an oil suction opening portion 82 is formed at a place opposed to the oil pump 38.

Oil strainer mounting groove 109*d* for placing the oil strainer 90 is formed in the vicinity of the oil introduction opening portion 81 of the oil passage 109*c* so that the inner circumferential surface of the oil passage 109*c* is depressed like a groove extending in the circumferential direction.

Along the outer circumference of the oil passage 109*c*, a mounting flange portion 109*e* for mounting an oil pan cover 191 (to be described later) is formed.

In the mounting flange portion 109*e*, a concavely depressed water jacket 192 is formed along the outer circumference of the oil passage 109*c* in such a way as to surround the oil passage 109*c*.

The oil pan cover 191 for covering the oil passage 109*c* formed in the bottom portion 109*a* is provided in the swelled bottom portion 109*a*.

The oil pan cover 191 is formed separately from the oil pan 109. As shown in FIG. 7, a part opposite to the oil passage 109*c* is formed by being swelled to the direction of an inner side opposite to the crankcase (that is, downwardly as viewed in this figure). This part and the oil passage 109*c* constitute the oil passage 191*c* enabling the circulation of oil.

Oil strainer mounting groove (not shown and corresponding to the oil strainer mounting groove 91*d* shown in FIG. 4) is formed by being depressed along the inner circumference in the oil passage 191*c* of the oil pan cover 191. During a state in which the oil strainer is mounted in the oil pan 109, the oil strainer mounting groove 191*d* is nearly continued to the oil strainer mounting groove 109*d* formed in the oil passage 109*c* of the oil pan 109, so that the oil strainer 90 is frontwardly placed, as viewed in a side view.

As illustrated in FIG. 7, a concavely depressed water jacket 193 is formed along the outer circumference of the oil passage 191*c* in a place opposed to the water jacket 192, which is formed in the oil pan 109, in such a way as to surround the oil passage 191*c*.

Union 194 serving as a flow tube communicated with the water jacket 193 is provided on both the left and right side walls in such a way as to project in the direction of width. Coolant water piping 195 is connected to the union 194.

The second embodiment is configured as described above. Thus, the oil pan structure for a four-cycle engine according to the second embodiment has advantages similar to those of the oil pan structure for a four-cycle engine according to the first embodiment. The water jackets 192 and 193 are configured in such a way as to surround the outer circumference portions of the oil passages 109*c* and 191*c*. Thus, the water jackets 192 and 193 can effectively refrigerate oil at places, which are far from sources for generating heat (for example, a cylinder and a cylinder head), as oil coolers.

Further, according to the second embodiment, the coolant water piping 195 communicated with the water jackets 192 and 193 is provided in a side wall portion of the oil pan cover 191. Thus, nothing projects to the bottom of the oil pan cover 191, so that the engine can be provided in such a way as to have a low height.

Incidentally, in the second embodiment, the water jackets 192 and 193 are formed along the outer side portions of the oil passages 109*c* and 191*c* in such a manner as to surround side portions of the passages 109*c* and 191*c*. However, the invention is not limited to the structure employing such water jackets. For example, the oil pan structure may be configured so that a water jacket is formed on the bottom portion of the oil pan cover 191, that is, the bottom portion of the oil passage 191*c* thereby to refrigerate a wide area of the oil passage and to enhance cooling effects.

Incidentally, although the engine employing the dry sump method as an oil lubrication method is described by way of example in the foregoing description of the aforementioned first and second embodiments, the invention is not limited to such an oil lubrication method. The invention can be applied to the engine employing, for instance, a wet sump method.

Further, although the engine mounted on the snowmobile has been described by way of example in the description of the aforementioned first and second embodiments, the invention is not limited to the configuration and the constituent parts of the engine. Needless to say, various modifications can be made without departing from the spirit of the invention. For example, the oil pan structure of the invention may be employed in an engine to be mounted on a planing boat. Further, the invention can be developed in another vehicle such as a motorcycle.

As described above, the oil pan structure for a four-cycle engine according to the invention can obtain excellent effects that the height of the engine is reduced by constructing a space-saving oil passage of a simple configuration, and that the oil pan structure for a four-cycle engine, which has good workability, can be realized.

Particularly, the invention relates to an oil pan structure for a four-cycle engine to be mounted on a compact vehicle, such as a motor cycle or a snowmobile. According to the invention, there is provided an oil pan structure for a four-cycle engine configured so that an oil pan is provided in a lower part of a crankcase, that the oil stored in the oil pan is sucked by an oil pump through an oil strainer, and that oil lubrication is performed by supplying the oil again to each of parts to be lubricated. In this structure, a bottom portion of the oil pan is formed by being swelled nearly like a bowl to a side opposite to the crankcase from an attaching peripheral portion 9*b* toward a central portion. A cover member covering a part of the bottom portion is separately provided on a swelled portion of the bottom portion. An oil passage is formed from the cover member and the bottom portion. An oil introduction opening portion, which communicates the oil passage to inside of a crankcase, and an oil suction opening portion, in which a communicate member communicating the oil passage to the oil pump is provided, are formed in the bottom portion. Thus, the suction of oil can be performed without providing a piping for oil strainer and an oil suction tube in the crankcase. Thus, the space of the oil pan can be increased. More miniaturization thereof can be realized.

Further, according to the invention, the oil strainer is provided on the oil passage constituted by the oil pan and the cover member. Thus, the mounting of the oil strainer can easily be performed without fail. Consequently, troubles due to vibrations can be constrained. Furthermore, more favorable workability can be obtained by providing the oil strainer in the vicinity of the oil introduction opening portion.

Further, according to the invention, the communication member has a pipe member communicating the oil pump to the oil passage, that an end of the pipe member is integrally attached to the oil pump, and that the other end of the pipe member is detachably attached to the oil suction opening portion through a seal member. Thus, the pipe member is not tightly fitted into the oil suction opening portion. This increases the degree of flexibility in attaching the crankcase lower part to the oil pan. Thus, the assemblability can be drastically improved. Additionally, only oil passing through the oil strainer can be sucked without mixing oil, which is present in the oil pan, thereinto.

Furthermore, according to the invention, a coolant water passage is formed in an outer circumferential portion of said oil passage. That is, the invention obtains the following excellent effect. That is, the oil cooler can be constituted in the outer circumferential portion of the oil passage in such a way as to have a simple configuration.

What is claimed is:

1. An oil pan structure, for a four-cycle engine having an oil pan connected to a lower part of a crank case and an oil pump for sucking an oil stored in the oil pan through an oil strainer and supplying the oil to parts of the engine for lubrication, comprising:

a swelled portion formed on a bottom portion of the oil pan by swelling the bottom portion to a side opposite to the crankcase;

a cover member provided on the swelled portion for covering a part of the bottom portion;

an oil passage configured by the cover member and the bottom portion;

an oil introduction opening portion formed in the bottom portion for connecting the oil passage and inside of the crankcase, and an oil suction opening portion formed in the bottom portion having a communication member for communicating the oil passage and the oil pump.

2. An oil pan structure according to claim 1, wherein the oil strainer is interposed between the cover member and the bottom portion.

3. An oil pan structure, for a four cycle engine having an oil pan connected to a lower part of a crank case and a oil pump for sucking an oil pan through an oil strainer and supplying the oil to part of the engine for lubrication, comprising:

a swelled portion formed on a bottom portion of the oil pan by swelling the bottom portion to a side opposite to the crankcase;

a cover member provided on the swelled portion for covering a part of the bottom portion;

an oil passage formed from the cover member and the bottom portion;

an oil introduction opening portion formed in the bottom portion for connecting the oil passage and inside of the crankcase; and an oil suction opening formed in the bottom portion having a communication member for connecting the oil passage and the oil pump, wherein the communication member has a pipe member oil pump and the oil passage, and an end of the pipe member is integrally attached to the oil pump, and the other end of the pipe member is detachably attached to the oil suction opening portion through a seal member.

4. An oil pan structure according to claim 1, wherein a coolant water passage is formed in an outer circumferential portion of the oil passage.

5. An oil pan structure according the claim 1, wherein the oil sucked by the oil pump is sent to an oil tank.

* * * * *